US007083352B2

(12) United States Patent
Ando et al.

(10) Patent No.: US 7,083,352 B2
(45) Date of Patent: Aug. 1, 2006

(54) BALLPOINT PEN

(75) Inventors: Masashi Ando, Aichi (JP); Hideyuki Tanaka, Aichi (JP)

(73) Assignee: The Pilot Ink Co, Ltd., Aichi (JP)

( * ) Notice: Subject to any disclaimer, the term of this patent is extended or adjusted under 35 U.S.C. 154(b) by 296 days.

(21) Appl. No.: 10/281,247

(22) Filed: Oct. 28, 2002

(65) Prior Publication Data

US 2004/0213629 A1 Oct. 28, 2004

(30) Foreign Application Priority Data

Oct. 31, 2001 (JP) ..... P.2001-335317

(51) Int. Cl.
*B43K 7/10* (2006.01)

(52) U.S. Cl. ..... 401/214; 401/216
(58) Field of Classification Search ..... 401/209–216
See application file for complete search history.

(56) References Cited

U.S. PATENT DOCUMENTS 5,000,605 A 3/1991 Schneider
6,193,429 B1 * 2/2001 Kim ..... 401/214
6,220,774 B1 * 4/2001 Fukushima ..... 401/214

FOREIGN PATENT DOCUMENTS

| | | |
|---|---|---|
| DE | 27 43 888 A1 | 9/1977 |
| DE | 35 02 088 C1 | 1/1985 |
| GB | 2 065 565 A | 7/1981 |
| GB | 2 067 475 A | 7/1981 |
| JP | 57-193578 | 6/1956 |
| JP | 09-220513 A | 8/1997 |
| JP | 2577544 | 5/1998 |
| JP | 2002-254878 A | 9/2002 |
| JP | 2003-103980 A | 4/2003 |

* cited by examiner

*Primary Examiner*—David J. Walczak
(74) *Attorney, Agent, or Firm*—Sughrue Mion, PLLC

(57) ABSTRACT

An ballpoint pen has: a tip body made of metal having an front edge part and a plurality of inward protrusions; a ball rotatably embraced between the front edge part and the inward protrusions; and a rod part urging the ball forwardly and bringing the ball into close contact with the inner surface of the front edge part, wherein ink outflow gaps are formed each between the adjacent inward protrusions, the rod part is inserted into the central part of the ink outflow gaps, the diameter of a virtual inscribed circle of the central part of the ink outflow gaps is larger than the outside diameter of the rod part, and a minimum dimension of each the ink outflow gap is smaller than the outside diameter of the rod part.

12 Claims, 3 Drawing Sheets

BALLPOINT PEN

BACKGROUND OF THE INVENTION

1. Field of the Invention

The present invention relates to a ballpoint pen. More particularly, the invention relates to a ballpoint pen of the type in which a plurality of inward protrusions for ball receiving seats are formed, by inward press deforming, on the side wall of the tip, and a ball is urged forward by a rod part as passed through a space defined by the ink outflow gaps each between the adjacent inward protrusions.

2. Description of the Related Art

A technique that a rod part, for urging the ball forward, is passed through a space defined by the ink outflow gaps each between the adjacent inward protrusions, is known for a conventional art of this type of ballpoint pen (see Japanese Utility Model Laid-Open No. 57-193578 and Japanese Utility Model No. 2577544).

In the conventional ballpoint pen, a minimum gap dimension of the ink outflow gap is larger than the outside diameter of the rod part. Further, each ink outflow gap is configured such that its gap dimension gradually increases from the center to the outer periphery edge part, viz., each ink outflow gap has a waist part of the smallest gap dimension at a middle part between the periphery edge part and the center of the ink outflow gap. With such a configuration of the ink outflow gap, the rod part is set off from the center of the space defined by the ink outflow gaps at the time of assembling, and enters a part near the periphery edge part of the ink outflow gap. As a result, the rod part inappropriately presses the rear face of the ball to possibly cause defective assembling (for example, defective rotation of the ball or poor contact between the ball and the inner surface of the edge part).

SUMMARY OF THE INVENTION

Accordingly, an object of the present invention is to provide a ballpoint pen which prevents a rod part from entering the periphery edge part of the ink outflow gap at time of assembling, enables the rod part to appropriately urge the ball forward, and is free from the defective assembling.

A ballpoint pen, according to a first aspect of the present invention, is constructed as follows. A ballpoint pen includes a tip body made of metal having a front edge part and a plurality of inward protrusions, the front edge part being inwardly bent at a front edge of the tip body. The inward protrusions are formed by pressure deformation and located on the inner side wall of the tip body and at a rearward of the front edge part. A ball is rotatably embraced between the front edge part and the inward protrusions and a rod part urges the ball forwardly and brings the ball into close contact with the inner surface of the front edge part. Ink outflow gaps extend outwardly in a radial direction from the center of the tip body and are formed each between the adjacent inward protrusions, the rod part is inserted into the space defined by the ink outflow gaps, the diameter of a virtual inscribed circle of the central part of the ink outflow gaps is larger than the outside diameter of the rod part, and a minimum dimension of each the ink outflow gap is smaller than the outside diameter of the rod part.

Thus, in the first aspect of the present invention, the diameter of a virtual inscribed circle of the central part of the ink outflow gaps is set to be larger than the outside diameter of the rod part, and a minimum dimension of each ink outflow gap is set to be smaller than the outside diameter of the rod part. With this feature, there is no fear that at the time of assembling, the rod part enters a part near the periphery edge part of the ink outflow gaps. The rod part appropriately pushes the rear face of the ball forward. Hence, there is no chance of occurrence of the defective assembling.

In the specification, "the diameter B of a virtual inscribed circle of the central part of the ink outflow gaps 4" means the diameter of a virtual inscribed circle contacting the apexes of the inward protrusions 22. "A minimum dimension M of each ink outflow gap 4" indicates a minimum dimensional value of the gap between the adjacent inward protrusions 22. "The outside diameter A of the rod part 51" indicates a maximum value of the outside diameter of the rod part 51. The "rod part 51" may be bent or deformed by compression, and an elastic member, such as a coil or rubber, may be disposed at the rear end of the rod part. A cross section of the rod part 51 may take a suitable shape, such as a circular, elliptical, or polygonal shape.

In a second aspect of the present invention, a radial distance between a minimum dimension part of the ink outflow gap and the periphery edge part of the ink outflow gap is 50% or smaller (preferably 45% or smaller) of the outside diameter of the rod part.

In the second aspect, the minimum dimension part of the ink outflow gap is located a distance, which is 50% or smaller of the outside diameter of the rod part, from the periphery edge part, viz., it is located at a position near the periphery edge part or at the position of the periphery edge part. Therefore, there is no chance that the rod part is caught between the minimum dimension part of the ink outflow gap and the periphery edge part of the ink outflow. Accordingly, chance of occurrence of the defective assembling is further lessened. If the distance is 50% or larger of the outside diameter of the rod part, the rod part forcibly expands the ink outflow gap, and will enter a space between the minimum dimension part of the ink outflow gap and the periphery edge part. The minimum dimension part of the ink outflow gap may be located at the position of the periphery edge part of the ink outflow gap (L=0). In this case, the ink outflow gap is configured such that its gap dimension gradually decreases from the center toward the radial outside.

In a third aspect of the present invention, a minimum dimension of each ink outflow gap is 70% or smaller (preferably 65% or smaller) of the outside diameter of the rod part.

In the third aspect, chance of catching the rod part at the ink outflow gap is further lessened. If the minimum dimension of each ink outflow gap is 70% or larger of the outside diameter of the rod part, the rod part expands the ink outflow gap, and will forcibly enter the ink outflow gap. The minimum dimension of each ink outflow gap may be zero. In this case, the adjacent inward protrusions come in contact with each other.

DETAILED DESCRIPTION OF THE INVENTION

Preferred embodiments of the present invention will be described with reference to the accompanying drawings.

<Embodiment>

Figure 1:
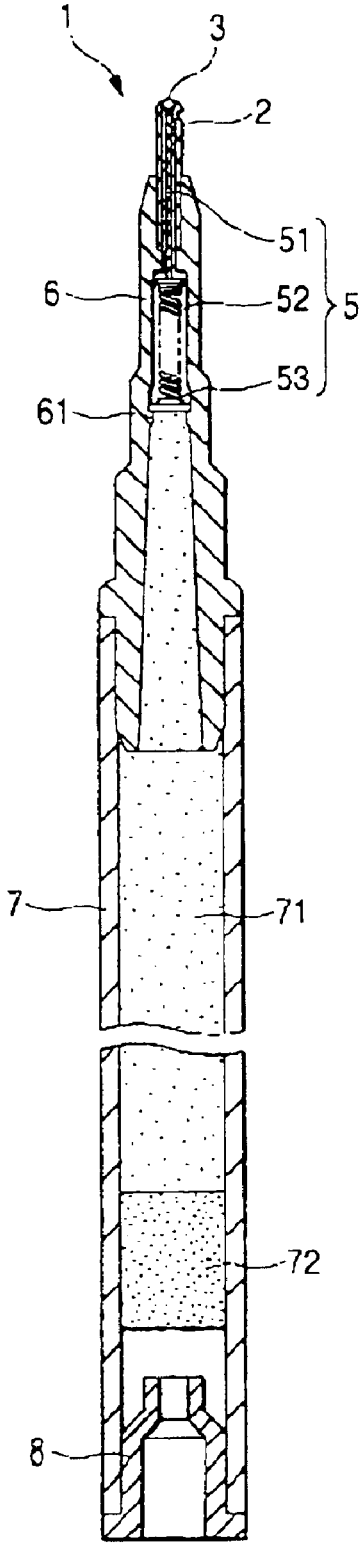
FIG. 1 is a longitudinal sectional view showing an embodiment to the present invention.
Figure 2:
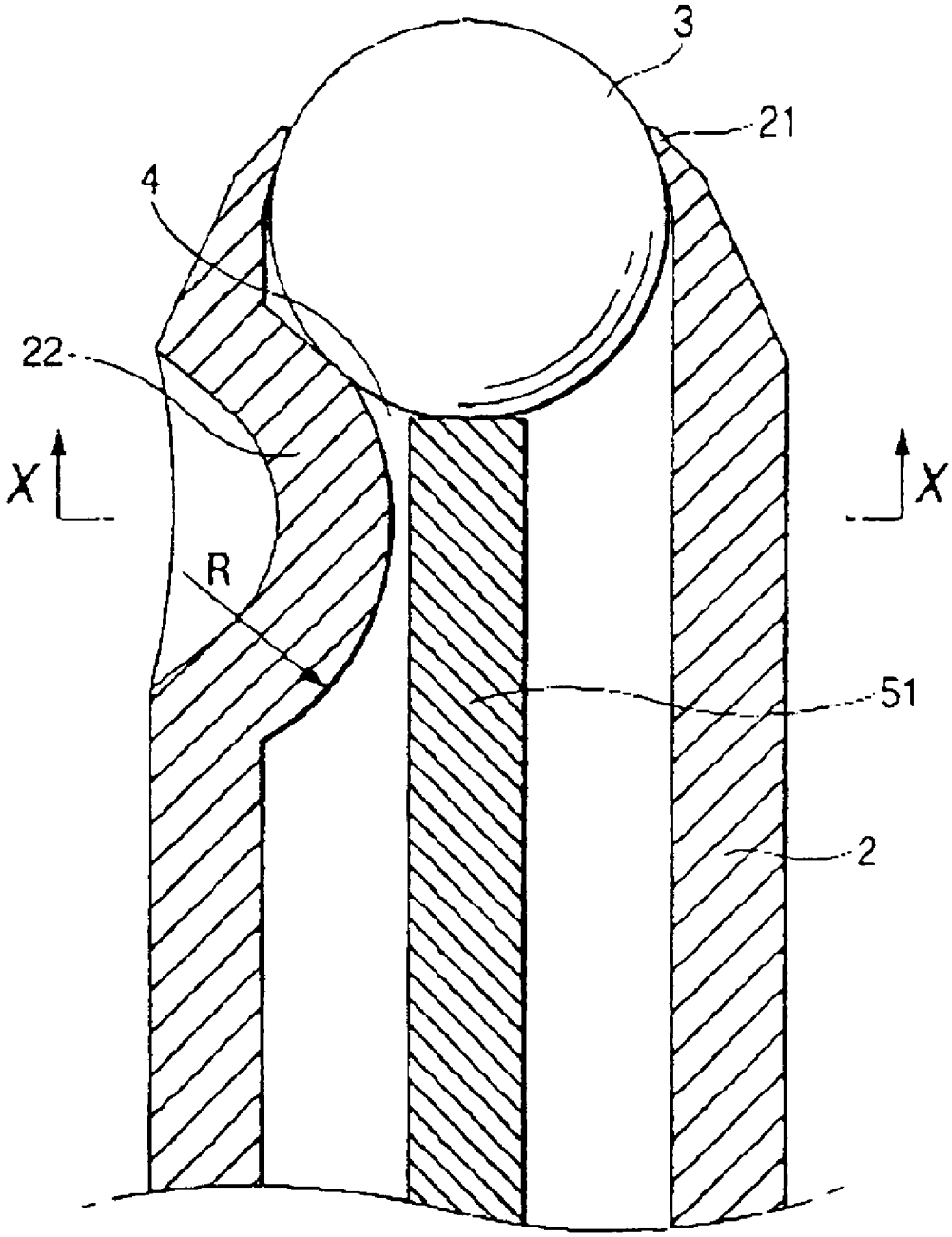
FIG. 2 is a longitudinal sectional view showing a major portion of the FIG. 1 embodiment.
Figure 3:
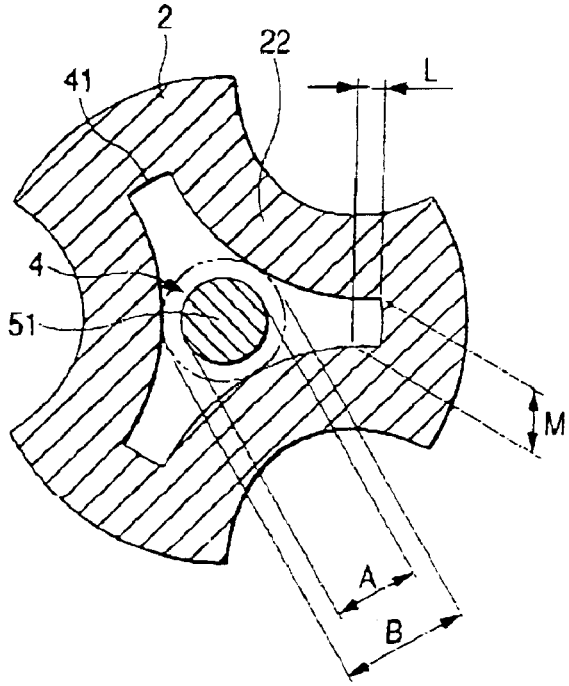
FIG. 3 is a cross sectional view taken on line X—X in FIG. 2.

An embodiment of the invention is shown in FIGS. 1 through 3.

A ballpoint pen 1 is composed of a tip body 2 which rotatably embraces a ball 3 at the tip, a holder 6 to which a rear part of the tip body 2 is press fit and fastened, an ink storage tube 7 having an opening part at the front end to which a rear part of the holder 6 is press fit and fastened, a spring section 5 which is located within the tip body 2 and the holder 6, and includes a rod part 51 at its tip, and a tail plug 8 to be press fit and fastened to an opening part at the rear end of the ink storage tube 7.

The ink storage tube 7 is a tubular body, which is opened at both ends and formed by resin extrusion molding. A rear part of the holder 6 with the tip body 2 is press fit and fastened to the opening part of the front end of the ink storage tube 7. The tail plug 8 having an air passage hole passing therethrough is press fit and fastened to the opening part of the rear end of the ink storage tube 7. The ink storage tube 7 is filled with an ink 71 (e.g., a aqueous gel ink having a shear viscosity reducing, or an oil-based ink of an intermediate viscosity), and grease like follower material 72 which is located at the rear end of the ink 71 and moves forward with consumption of the ink 71.

The tip body 2 consists of a straight cylindrical member (outside diameter=0.8 mm, and inside diameter=0.52 mm) made of metal (for example, austenite stainless steel, such as SUS304 or SUS321). An edge part 21, which is inwardly bent and annular as viewed from top, is formed at the apex of the tip body 2 by inward press deforming. Three inward protrusions 22 (i.e., ball receiving seats), while being equiangularly arranged, are formed, by inward press deforming, on the inner side wall of the tip body 2, which is located rearwardly of the edge part 21. A ball 3 (outside diameter=0.5 mm) is rotatably embraced at a part (i.e., ball embracing part) between the inner surface of the edge part 21 and the front surface of the inward protrusions 22.

Ink outflow gaps 4, which extend outwardly from the center of the tip body in three radial directions, are formed each between the adjacent inward protrusions 22. A rod part 51 of the spring section 5 is passed through the center of a space defined by the ink outflow gaps 4, and the tip of the rod part 51 is brought into contact with the rear face of the ball 3 to thereby urge the ball 3 forward.

In the embodiment, the diameter B of a virtual inscribed circle of the central part of the ink outflow gaps 4 is 0.2 mm. The outside diameter A of the rod part 51 is 0.14 mm. A minimum dimension M of each ink outflow gap 4 is 0.082 mm (=58.6% of the outside diameter A of the rod part 51). A radial distance L between the minimum dimension part of the ink outflow gap 4 and the periphery edge part 41 of the ink outflow gap 4 is 0.05 mm (=35.7% of the outside diameter A of the rod part 51).

With such a dimensional configuration, there is no chance that the rod part 51 enters a part near the periphery edge part 41 of the ink outflow gap 4 or that it is caught at the ink outflow gap 4. Accordingly, the rod part 51 is reliably positioned at the center of a space defined by the ink outflow gaps 4, the tip of the rod part 51 abuts against the rear face of the ball 3, and the rod part appropriately urges the ball 3 forward. As a result, prevention is made of the defective assembling, such as defective rotation of the ball 3, or poor contact between the ball 3 and the inner surface of the edge part 21.

An apex of each inward protrusion 22 has a smooth curved surface. A radius of curvature R at the apex of the inward protrusion 22 is selected to be larger than the radius of the ball 3. Therefore, when the rod part 51 is inserted into the space defined by the ink outflow gaps 4, the rod part 51 is smoothly guided along the rear surfaces of the inward protrusions 22 to the center of the space defined by the ink outflow gaps 4, while the tip of the rod part 51 is not caught by the rear surfaces of the inward protrusions 22.

The holder 6 is a tubular member made of synthetic resin (e.g., polyacetal) by injection molding. The holder 6 includes a front part, tapered to its extremity, to which the tip body 2 is attached, a collar part brought into contact with the front end face of the ink storage tube 7, and a rear part press fit into the front end opening of the ink storage tube 7. A tip mounting hole of which the front end is opened, and an ink flowing elongated hole the front end of which communicates with the tip mounting hole and the rear end of which is opened to exterior are provided within the holder 6. A plurality (for example, 4) of protrusions 61, while being angularly arranged, are provided on the inner surface of a mid position of the ink flowing elongated hole.

The spring 5 is formed of a stainless steel wire of 0.14 mm in diameter of wire, and consists of a rod part 51 as its front part and a coil part 52 as its rear part. An inflatedly projected part 53 of which the outside diameter is larger than that of the front part of the coil part 52. The inflatedly projected part 53 is formed by the seat winding of a wire as densely wound. The inflatedly projected part 53 is moved beyond the protrusions 61 on the inner surface of the holder 6, from the rear side, and latched at the protrusions 61.

At non-writing, the ball 3 is pressed forward by the rod part 51 of the spring section 5, and pressed against the inner surface of the tip apex edge part 21. As a result, the pen point is sealed. Accordingly, even when the ballpoint pen is left with its pen point directed downward, no ink leaks from the pen point. Even when it is left with its pen point directed upward, no air enters the ballpoint pen through the pen point.

<Another Construction of Ink Outflow Gaps>

Figure 4:
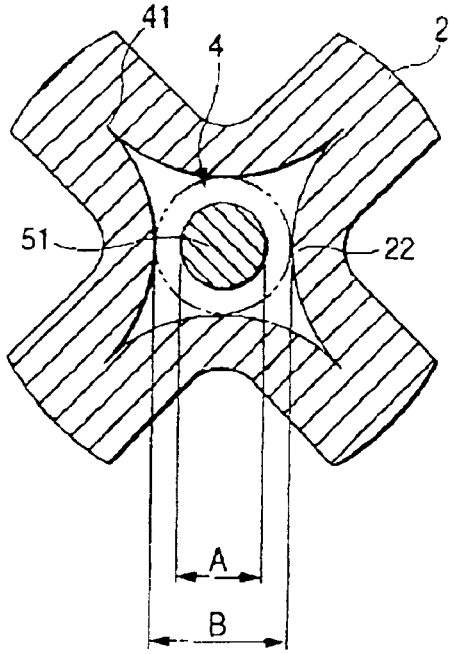
FIG. 4 is a diagram showing an end face of another construction of ink outflow gaps constructed according to the present invention.

FIG. 4 shows another construction of ink outflow gaps 4.

In the instant embodiment, four ink outflow gaps 4 are arrayed such that each ink outflow gap is located between the adjacent inward protrusions 22. A diameter B of a virtual inscribed circle of the ink outflow gaps 4 is 0.25 mm, and the outside diameter A of the rod part 51 is 0.14 mm.

In the embodiment, each ink outflow gap 4 is configured such that its gap dimension gradually decreases from the center to the periphery edge part 41, and the adjacent inward protrusions 22 are in close contact with each other at the periphery edge part 41. Accordingly, the minimum dimension M of each ink outflow gap 4, and the radial distance L between the minimum dimension part of the ink outflow gap 4 and the periphery edge part 41 of the ink outflow gap 4 are selected to be zero (M=0 and L=0). With such a dimensional configuration, there is no chance that the rod part 51 enters a part near the periphery edge part 41, and the rod part 51 is reliably positioned at the center of a space defined by the ink outflow gaps 4.

In the instant embodiment, the outside diameter and the inside diameter of the tip body 2 are 1.0 mm and 0.73 mm, and the outside diameter A of the ball 3 is 0.7 mm. A ballpoint pen 1 which is constructed by using the tip body 2 of the instant embodiment in place of the tip body 2 of the FIG. 1 embodiment, has advantages comparable with those of the FIG. 1 embodiment.

As seen from the foregoing description, the first aspect of the invention brings about the following advantages. There is prevented that at the time of assembling, the rod part enters a part near the periphery edge part. The rod part is allowed to appropriately push forward the rear face of the ball. Hence, there is no chance of occurrence of the defective assembling.

In the second aspect of the invention, there is no chance that the rod part is caught between the minimum dimension part of the ink outflow gap and the periphery edge part of the ink outflow. Accordingly, chance of occurrence of the defective assembling is further lessened.

In the third aspect of the invention, chance of catching the rod part at the ink outflow gap is further lessened.

What is claimed is:

1. A ballpoint pen comprising:

a tip body made of metal having a front edge part and a plurality of inward protrusions, the front edge part being inwardly bent at a front edge of the tip body, and the inward protrusions being formed by pressure deformation and located on the inner side wall of the tip body and at a rearward portion of the front edge part;

a ball rotatably embraced between the front edge part and the inward protrusions; and a rod part urging the ball forwardly and bringing the ball into close contact with the inner surface of the front edge part, wherein ink outflow gaps extended outwardly in a radial direction from the center of the tip body are formed each between the adjacent inward protrusions, the rod part is inserted into the space defined by the ink outflow gaps, the diameter of a virtual inscribed circle of the central part of the ink outflow gaps is larger than the outside diameter of the rod part, and a minimum dimension of each the ink outflow gap is smaller than the outside diameter of the rod part, wherein a radius of curvature at the apex of the inward protrusions is larger than the radius of the ball.

2. The ballpoint pen as set forth in claim 1, wherein a radial distance between a minimum dimension part of the ink outflow gap and the periphery edge part of the ink outflow gap is 50% or smaller of the outside diameter of the rod part.

3. The ballpoint pen as set forth in claim 1 or 2, wherein a minimum dimension of each the ink outflow gap is 70% or smaller of the outside diameter of the rod part.

4. The ballpoint pen as set forth in claim 1 or 2, wherein the inward protrusions are formed at least three.

5. The ballpoint pen as set forth in claim 1 or 2, wherein the minimum dimension part of the ink outflow gap is located at the position of the periphery edge part of the ink outflow gap.

6. The ballpoint pen as set forth in claim 1 or 2, wherein the adjacent inward protrusions contact with each other in the periphery edge part of the ink outflow gap.

7. The ballpoint pen as set forth in claim 1, wherein the rod part is substantially straight and cylinder shaped.

8. A ballpoint pen comprising:

a tip body having a front edge part and a plurality of inward protrusions, the front edge part being inwardly bent at a front edge of the tip body, and the inward protrusions located on the inner side wall of the tip body and at a rearward portion of the front edge part;

a ball rotatably embraced between the front edge part and the inward protrusions; and a rod part urging the ball forwardly and bringing the ball into close contact with the inner surface of the front edge part, wherein ink outflow gaps extended outwardly in a radial direction from the center of the tip body are formed each between the adjacent inward protrusions, the rod part is inserted into the space defined by the ink outflow gaps, wherein a radius of curvature at the apex of the inward protrusions is larger than the radius of the ball.

9. A ballpoint pen comprising:

a tip body made of metal having a front edge part and a plurality of inward protrusions, the front edge part being inwardly bent at a front edge of the tip body, and the inward protrusions being formed by pressure deformation and located on the inner side wall of the tip body and at a rearward portion of the front edge part;

a ball rotatably embraced between the front edge part and the inward protrusions; and a rod part having a tip; said tip urging the ball forwardly and bringing the ball into close contact with the inner surface of the front edge part, wherein ink outflow gaps extended outwardly in a radial direction from the center of the tip body are formed each between the adjacent inward protrusions, the rod part is inserted into the space defined by the ink outflow gaps, the diameter of a virtual inscribed circle of the central part of the ink outflow gaps is larger than the outside diameter of the rod part, and a minimum dimension of each of the ink outflow gaps is smaller than the outside diameter of the rod part, wherein the rod part is substantially straight and cylinder shaped.

10. The ballpoint pen as set forth in claim 9, wherein a radial distance between a minimum dimension part of the ink outflow gap and a periphery edge part of the ink outflow gap is 50% or smaller of the outside diameter of the rod part.

11. The ballpoint pen as set forth in claim 9, wherein a minimum dimension of each of the ink outflow gaps is 70% or smaller of the outside diameter of the rod part.

12. The ballpoint pent as set forth in claim 9, further comprising a spring integrally formed at a rear of the rod.

* * * * *